US005123577A

United States Patent [19]

Kolton et al.

[11] Patent Number: 5,123,577

[45] Date of Patent: Jun. 23, 1992

[54] HANGER FOR GARMENT ACCESSORIES WITH PLURAL RETENTION MEMBERS IN SLOTTED OPENING

[75] Inventors: Chester Kolton, Westfield; Stuart S. Spater, Livingston, both of N.J.

[73] Assignee: B&G Plastics, Inc., Newark, N.J.

[21] Appl. No.: 619,300

[22] Filed: Nov. 28, 1990

[51] Int. Cl.[5] ..... A47G 25/30; A47G 25/28; A47G 25/14

[52] U.S. Cl. ..... 223/85; 223/91; 223/DIG. 1

[58] Field of Search ..... 223/DIG. 1, DIG. 4, 223/85, 91, 88, 81, 82, 87; 206/289, 290, 292, 293, 294, 295; D6/315

[56] References Cited

U.S. PATENT DOCUMENTS

| | | | |
|---|---|---|---|
| D. 254,644 | 4/1980 | Abramowitz | 223/DIG. 1 X |
| D. 259,164 | 5/1981 | Abramowitz | D6/315 |
| 1,535,102 | 4/1925 | Cohn | 206/294 X |
| 2,150,869 | 3/1939 | Shafarman | 223/DIG. 1 X |
| 2,264,957 | 12/1941 | Shafarman | 223/87 |
| 2,294,527 | 9/1942 | Weiss | 223/DIG. 1 X |
| 3,243,087 | 3/1966 | Pulitzer | 223/87 |
| 3,385,486 | 5/1968 | Finaw | 223/87 |
| 3,765,467 | 8/1988 | Kolton et al. | 223/DIG. 1 |

FOREIGN PATENT DOCUMENTS

| | | | |
|---|---|---|---|
| 92365 | 9/1968 | France | 223/87 |
| 1078507 | 8/1967 | United Kingdom | 223/87 |

*Primary Examiner*—Peter Nerbun
*Assistant Examiner*—Bibhu Mohanty
*Attorney, Agent, or Firm*—Robin, Blecker, Daley & Driscoll

[57] ABSTRACT

A garment accessory hanger comprises an integral frame having a hook portion and a body portion, the body portion defining an upper transverse marginal course, a lower transverse marginal course and opposed first and second side marginal courses interconnectnig the upper and lower transverse marginal courses. First and second deflectable arms extend respectively from the first and second side marginal courses, ends of the arms being mutually spaced, the upper transverse marginal course and the first and second arms bounding a first opening in the body portion. The lower transverse marginal course and the first and second arms bound a second opening in the body portion. A garment accessory retention member depends outwardly of the body portion upper transverse marginal course and toward the first and second arms, preferably depending centrally outwardly of the body portion upper transverse marginal course and into the space between the first and second arms.

1 Claim, 1 Drawing Sheet

10
12
12a
16
32
18a
16a
24
18
22
14
26b
26c
26
36
26a
30
24a
28
34
24c
24b
20
D1
D2
V

HANGER FOR GARMENT ACCESSORIES WITH PLURAL RETENTION MEMBERS IN SLOTTED OPENING

FIELD OF THE INVENTION

This invention relates to a garment accessory hanger such as for the hanging of ties, scarfs and like elongate articles of clothing.

BACKGROUND OF THE INVENTION

A commercially-known accessory hanger is integrally formed of plastic and includes a hook portion and a body portion, the latter having upper and lower symmetrical openings bounded by the upper and lower margins of the body portion and arms extending from the body side margins and having ends spaced from one another to provide a passage between the upper and lower openings.

The arms are deflectable out of the plane of the body portion and a looped portion of a accessory is applied to the arms. As the arms return under self-bias into the plane of the body portion, the garment is retained and may be displayed by placing the hook portion on a display rod.

From applicants' viewpoint, the described commercial hanger is not as effective as desired in respect of securely retaining accessories which are particularly thin in cross-section. Thus, ties or scarfs of such extreme thinness come to be readily disengaged from the hanger, as by slipping over and beyond the arms.

SUMMARY OF THE INVENTION

The present invention has as its object the provision of an improved hanger of the type under discussion.

In attaining this and other objects, the invention provides a garment accessory hanger comprising an integral frame having a hook portion and a body portion, the body portion defining an upper transverse marginal course, a lower transverse marginal course and opposed first and second side marginal courses interconnecting the upper and lower transverse marginal courses. First and second deflectable arms extend respectively from the first and second side marginal courses, ends of the arms being mutually spaced, the upper transverse marginal course and the first and second arms bounding a first opening in the body portion. The lower transverse marginal course and the first and second arms bound a second opening in the body portion. A garment accessory retention member depends outwardly of the body portion upper transverse marginal course and toward the first and second arms, preferably depending centrally outwardly of the body portion upper transverse marginal course and into the space between the arms.

In the particularly preferred embodiment of the hanger of the invention, additional garment retention members depend outwardly of the body portion upper surface transverse marginal course and into confronting relation to the first and second arms.

The foregoing and other features of the invention will be further understood from the following detailed description of a preferred embodiment thereof and from the drawings wherein like reference numerals identify like components and parts throughout.

DETAILED DESCRIPTION OF THE PREFERRED EMBODIMENT

Figures 1, 2, 3, 4, 5:
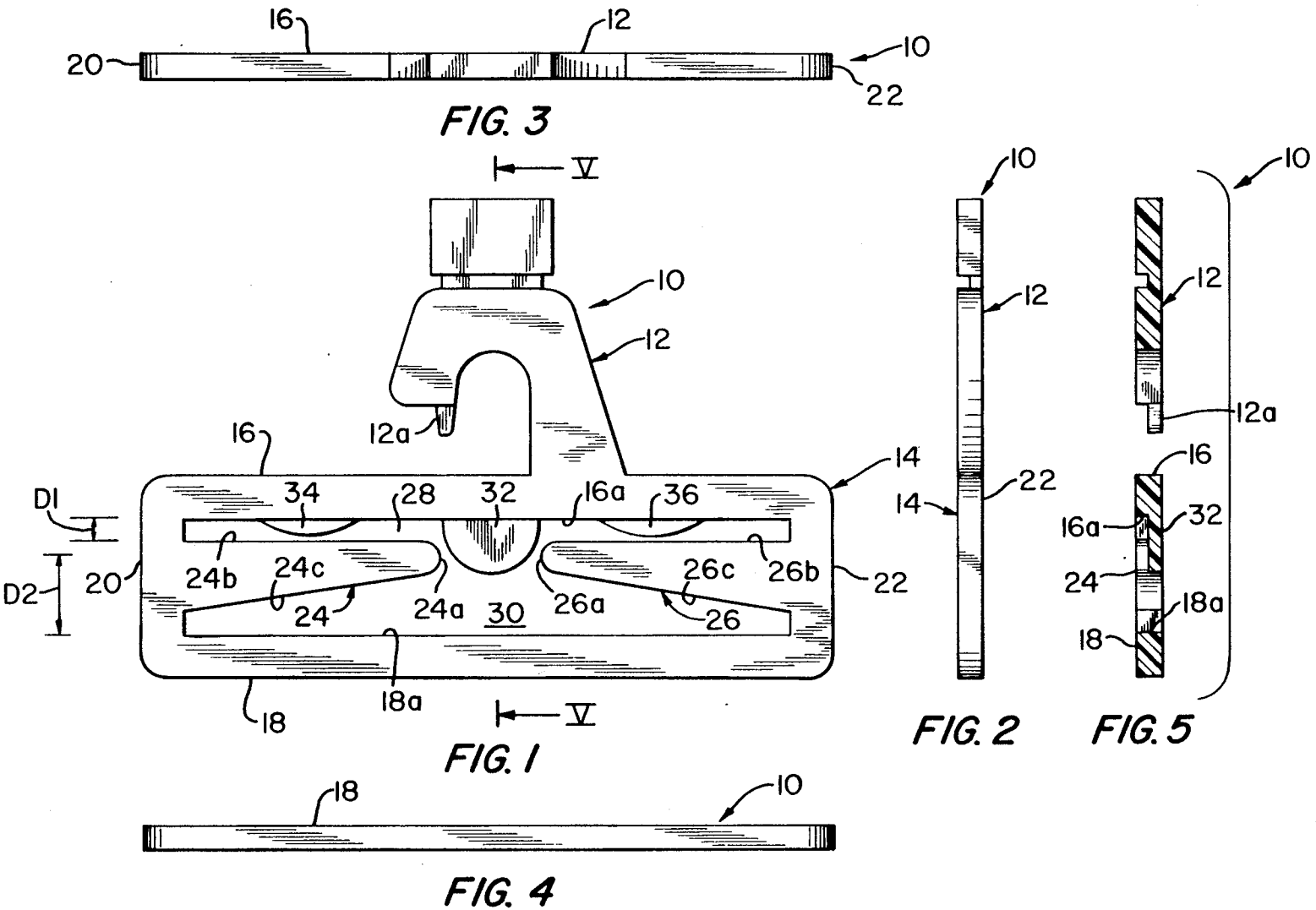
FIG. 1 is a front elevation of a hanger in accordance with the invention.
FIG. 2 is a right side elevation of the FIG. 1 hanger.
FIG. 3 is top plan view of the FIG. 1 hanger.
FIG. 4 is a bottom view of the FIG. 1 hanger.
FIG. 5 is a sectional view of the FIG. 1 hanger as would be seen from plane V—V of FIG. 1.

Referring to FIGS. 1–4, hanger 10 is comprised of an integral frame having a hook portion 12 and a body portion 14, the body portion defining an upper transverse marginal course 16, a lower transverse marginal course 18 and opposed first and second side marginal courses 20 and 22 interconnecting the upper and lower transverse marginal courses.

First and second deflectable arms 24 and 26 extend respectively from first and second side marginal courses 20 and 22, ends **24*a* and 26*a*** of the arms being mutually spaced.

Upper transverse marginal course 16 and first and second arms 24 and 26 bound a first opening 28 in body portion 14. Lower transverse marginal course 18 and first and second arms 24 and 26 bound a second opening 30 in body portion 14.

First opening 28 is of substantially lesser area than the second opening 30 per the invention, for purposes and effect below discussed. Further, in accordance with invention first and second arms 24 and 26 have respective surfaces **24*b* and 26*c* bounding the first opening which are parallel with surface 16*a* of upper transverse marginal course 16 bounding first opening 28. Also, first and second arms 24 and 26 having respective surfaces 24*c* and 26*c* bounding second opening 30 which extend at an acute angle with respect to surface 18*a* of lower transverse marginal course 18 bounding second opening 30**.

First opening 28 is of oval configuration and second opening 30 is of triangular configuration. A transverse dimension D1 of the oval is generally one-half of the height D2 of the triangle.

Hook portion 12 is of a first thickness generally thoughout its expanse, with a tail **12*a* of second thickness less than the first thickness at a free end of hook portion 12**.

As is set forth in a copending, commonly-assigned application for U.S. patent, entitled "Garment Accessory Hanger", Ser. No. 07/619,028, applicants have found that a hanger having the above-discussed configurational and size diversity as between openings 28 and 30 exhibits enhanced frictional relation between a tie or scarf inserted loopwise onto arms 24 and 26. Thus, Particularly, with surfaces **24*b* and 26*b* extending in parallel with surface 16*a* and closely spaced relative thereto, heightened friction exists atop the arms as between surfaces 24*b* and 26*b* and the accessory. Also, the increased acute angle, over that obtaining in the commercially-known hanger above discussed, of surfaces 24*c* and 26*c* with respect to surface 18*a* is found to enhance wedging of the accessory in opening 30**, likewise increasing friction between the hanger and the accessory.

On the other hand, applicants have noted limitations of the commercially-known hanger and the hanger of the copending application in hanging quite thin cross-section accessories, such as sashes.

In accordance with the present invention, one or more of garment retention members 32, 34 and 36 are associated with the undersurface 24*a*, extending outwardly, downwardly of upper transverse marginal course 16. Member 32 is located generally centrally of the hanger and extends into the space between arms 24 and 26 and is in the form of a semicircular disc cantilever-supported by and of less thickness that upper transverse marginal course 16, as is seen in FIG. 5. A garment is applied onto arms 24 and 26 in loop form with the arms distended from the plane of the hanger. As the arms self-biasingly return into the plane of the hanger, the garment is frictionally engaged between member 32 and each of arms 24 and 26.

Retention members 34 and 36 likewise extend outwardly, downwardly of course 16, generally centrally of arms 24 and 26, respectively, into confronting spaced relation therewith to frictionally engage a garment disposed thereon. Members 34 and 36 are likewise in the form of a semicircular disc cantilever-supported by and of less thickness that upper transverse marginal course 16.

Tail 12*a* will be appreciated as extending the hook portion into heightened circumscribing relation with display rod 32 and providing for lessened likelihood of undesired separation of the hanger from the display rod. On the other hand, given the lessened thickness of the tail relative to the hook portion at large, the tail is cantilever-supported and deflectable to permit removal of the hanger from the display rod when desired.

Various changes to structure and modifications in practice may be introduced in the foregoing embodiment and practice without departing from the invention. Thus, the particularly discussed and depicted embodiment is intended in an illustrative and not in a limiting sense. The true spirit and scope of the invention is set forth in the following claims.

I claim:

1. A garment accessory hanger comprising an integral frame having a hook portion and a body portion, said body portion defining an upper transverse marginal course, a lower transverse marginal course and opposed first and second side marginal courses interconnecting said upper and lower transverse marginal courses, and first and second deflectable arms extending respectively from said first and second side marginal courses, ends of said arms being mutually spaced to define an open area therebetween, said upper transverse marginal course and said first and second arms bounding a first opening in said body portion, said lower transverse marginal course and said first and second arms bounding a second opening in said body portion, a first garment retention member depending centrally outwardly of said body portion upper transverse marginal course and into said open area, said first arm, said second arm and said garment retention member collectively extending into an open area to frictionally engage a garment supported by said hanger, and additional garment retention members depending outwardly of said body portion upper transverse marginal course into confronting relation respectively to said first and second arms at locations distal from said open area, said first garment retention member and said additional garment retention members being all of less thickness than said upper transverse marginal course and being cantilever-supported thereby, said first garment retention member and said additional garment retention members being cooperative with said first and second arms to frictionally engage said garment supported by said hanger.

* * * * *